US005802819A

United States Patent [19]

Boldrini

[11] Patent Number: 5,802,819

[45] Date of Patent: Sep. 8, 1998

[54] METHOD AND DEVICE FOR FOLDING END PORTIONS OF TUBULAR WRAPPINGS

[75] Inventor: Fulvio Boldrini, Ferrara, Italy

[73] Assignee: G.D Societa'Per Azioni, Bologna, Italy

[21] Appl. No.: 850,592

[22] Filed: May 2, 1997

[30] Foreign Application Priority Data

May 6, 1996 [IT] Italy ..... B096A0240

[51] Int. Cl.[6] ..... B65B 7/04

[52] U.S. Cl. ..... 53/480; 53/482; 53/234

[58] Field of Search ..... 53/480, 482, 234, 53/232, 370.2, 371.7, 372.2, 372.5

[56] References Cited

U.S. PATENT DOCUMENTS

| | | | |
|---|---|---|---|
| 4,085,568 | 4/1978 | Focke et al. | 53/234 |
| 4,092,816 | 6/1978 | Seragnoli | 53/234 |
| 4,428,177 | 1/1984 | Focke et al. | 53/234 |
| 4,617,780 | 10/1986 | Focke et al. | 53/234 |
| 4,838,846 | 6/1989 | Focke et al. | 53/234 |
| 5,177,933 | 1/1993 | Boriani et al. | 53/234 |
| 5,477,661 | 12/1995 | Draghetti et al. | 53/234 |

FOREIGN PATENT DOCUMENTS 1086180 2/1967 United Kingdom .

*Primary Examiner*—James F. Coan
*Assistant Examiner*—Gene L. Kim
*Attorney, Agent, or Firm*—Klauber & Jackson

[57] ABSTRACT

A method and device for folding end portions of tubular wrappings, whereby a product enclosed inside a wrapping is fed along a path extending through a folding station, the wrapping having at least one end portion projecting in relation to an end surface of the product, and the end portion having a front portion which is folded onto the end surface by a movable folding plate located at the station; a drive device being provided to insert the plate between two sides of the end portion by so orienting the plate as to keep a lateral folding surface of the plate equidistant from, and substantially contacting, both sides.

12 Claims, 4 Drawing Sheets

PT
S
L
2
3
4
9
10
11
13
14
15
16
18
19
20
26
29

10
15
29
R
25
26
31
16
18
4
3
P.T.
D
9
2
11
30
S
13
19
14
P

METHOD AND DEVICE FOR FOLDING END PORTIONS OF TUBULAR WRAPPINGS

BACKGROUND OF THE INVENTION

The present invention relates to a method of folding end portions of tubular wrappings.

To wrap products, such as packets or cartons of cigarettes, the products are fed to a wrapping machine by which a sheet of wrapping material is applied about each product to form a tubular wrapping longer than the product and having two annular end portions, which project from, and are subsequently folded onto, respective end surfaces of the product.

The wrapping machine normally comprises a wrapping wheel for feeding the products along a substantially curved path, and which has a number of peripheral seats, each for housing a respective product with the annular end portions projecting axially outwards of the seat. More specifically, each annular end portion comprises two sides parallel to an instantaneous traveling direction of the product and separated by a given distance equal to the thickness of the product; and two lateral portions crosswise to said direction. The rear lateral portion, with respect to the traveling direction, is folded onto said end surface by a folding element integral with the wrapping wheel and movable together with and in relation to the respective seat; whereas the front lateral portion is folded onto the end surface by a folding plate located in a fixed position along the path and to the side of the wrapping wheel, and which presses against the front lateral portion as the product travels forward, and is narrower than the thickness of the product so as to pass between the two sides without touching them after folding the front lateral portion.

Folding the front lateral portion by means of a folding plate as described above involves several drawbacks due, firstly, to the plate pressing not only against the front lateral portion but also in most cases against the sides as well; and, secondly, to the fact that the narrowness of the plate prevents the front lateral portion from being folded properly.

SUMMARY OF THE INVENTION

It is an object of the present invention to provide a method of folding end portions of tubular wrappings, designed to overcome the aforementioned drawback.

According to the present invention, there is provided a method of folding end portions of tubular wrappings, the method comprising the step of feeding a product along a substantially curved path and in an instantaneous traveling direction tangent to the path, the product being enclosed inside a tubular wrapping having at least one annular end portion, and the annular end portion projecting with respect to an end surface of the product, and comprising two sides parallel to said instantaneous traveling direction and separated by a given distance equal to at least a thickness of the product, a rear portion folded onto said end surface, and a front portion crosswise to said instantaneous traveling direction; and the step of folding said front portion onto said end surface by means of a folding element located along said path; the method being characterized in that said folding step comprises the steps of moving the folding element in a plane coplanar with said end surface; gradually inserting the folding element between said sides so that an outer folding surface of the folding element is of a maximum width at most equal to said given distance; and so orienting the folding element as to keep the outer folding surface equidistant from, and substantially contacting, both said sides.

The present invention also relates to a device for folding end portions of tubular wrappings.

According to the present invention, there is provided a device for folding end portions of tubular wrappings, the device comprising conveying means for feeding a product along a substantially curved path and in an instantaneous traveling direction tangent to the path, the product being enclosed inside a tubular wrapping having at least one annular end portion, and the annular end portion projecting with respect to an end surface of the product, and comprising two sides parallel to said instantaneous traveling direction and separated by a given distance equal to at least a thickness of the product, a rear portion folded onto said end surface, and a front portion crosswise to said instantaneous traveling direction; and folding means located along said path to fold said front portion onto said end surface; the device being characterized in that said folding means comprise a movable folding element; and drive means for moving the folding element in a plane coplanar with said end surface, gradually inserting the folding element between said sides so that an outer folding surface of the folding element is of a maximum width at most equal to said given distance, and so orienting the folding element as to keep the outer folding surface equidistant from, and substantially contacting, both said sides.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
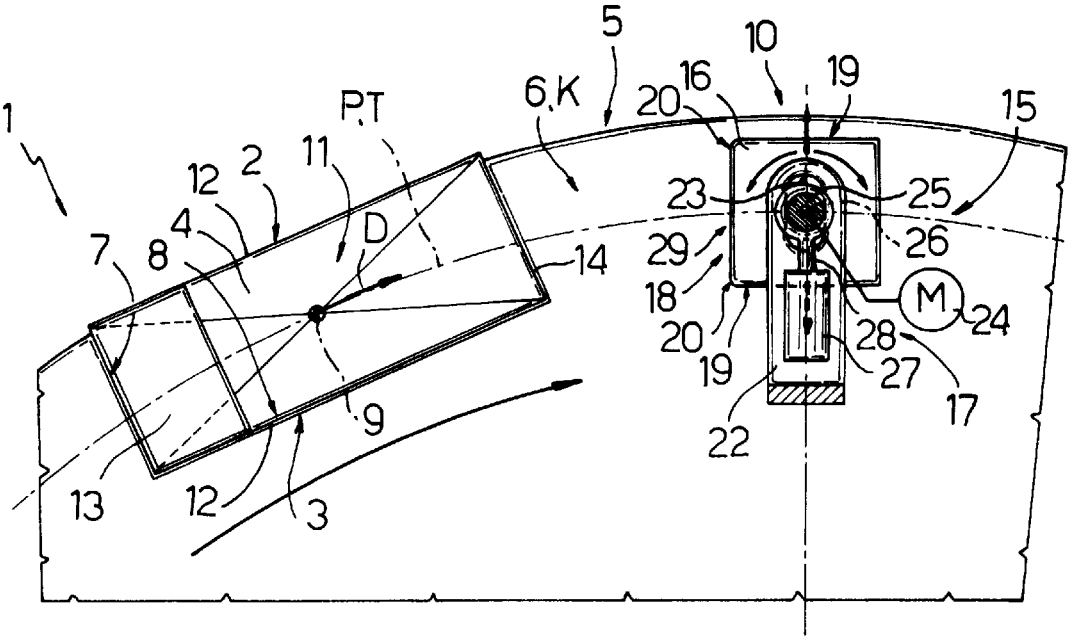
FIG. 1 shows a schematic view, with parts in section and parts removed for clarity, of a first preferred embodiment of a device for folding end portions of tubular wrappings in accordance with the teachings of the present invention.
Figure 2:
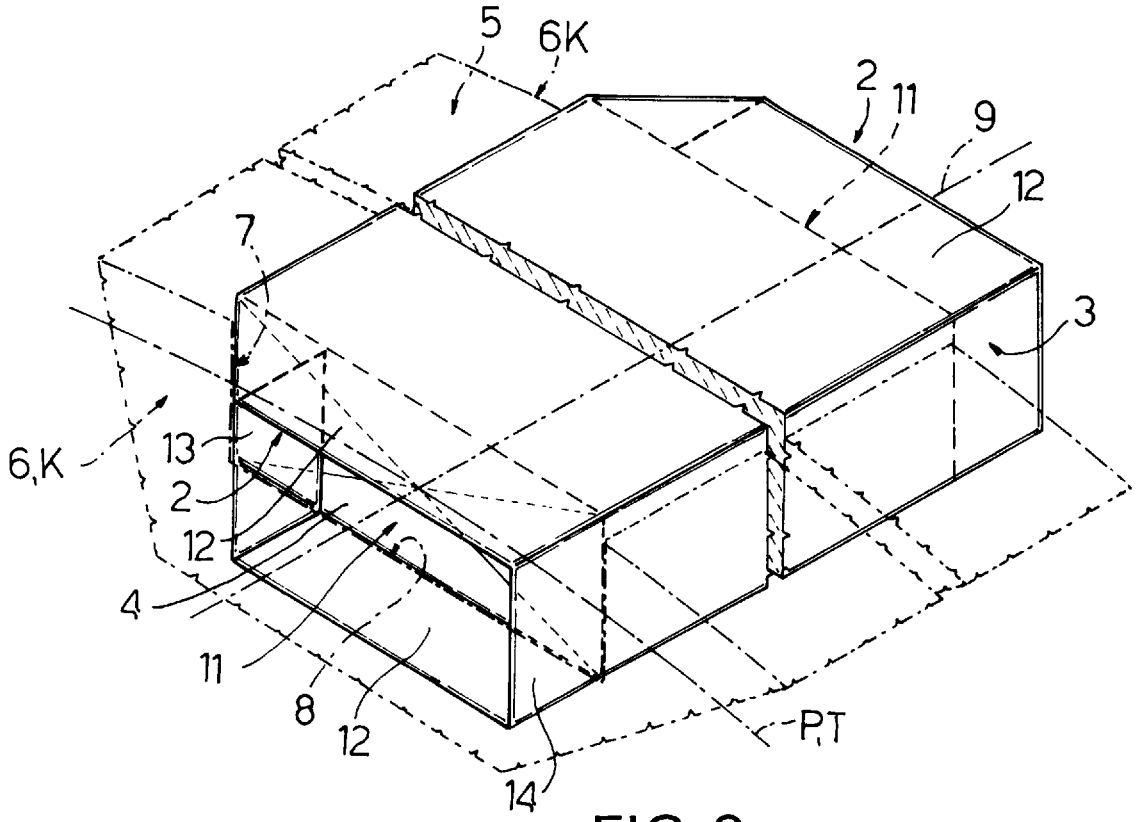
FIGS. 2 and 3 show larger-scale schematic views in perspective of a detail of FIG. 1 in two different operating conditions.

With reference to FIGS. 1 and 2, number 1 indicates a device for folding annular end portions 2 of tubular wrappings 3 formed about respective products 4 (only one shown) defined, in the example shown, by packets or cartons of cigarettes.

Device 1 comprises a known conveyor wheel 5 mounted for rotation about an axis (not shown) and defined axially by two lateral surfaces 6 crosswise to the axis of rotation. Wheel 5 receives products 4 at a loading station (not shown), feeds products 4 along a substantially curved path P and in an instantaneous traveling direction D tangent to path P, and unloads products 4 onto a further known conveyor wheel (not shown) at an unloading station (not shown) downstream from said loading station along path P.

Wheel 5 comprises a number of peripheral seats 7 (only one shown) equally spaced about said axis of rotation, and extending axially from one surface 6 to the other to define, on each surface 6, a respective lateral opening 8. Each seat 7 houses a respective product 4 with the long longitudinal axis 9 of product 4 parallel to said axis of rotation of wheel 5, and feeds product 4 crosswise to respective axis 9 and through two folding stations 10 (only one shown) located in series along path P and between the loading and unloading stations.

More specifically, each product 4 comprises two small lateral surfaces 11 crosswise to respective axis 9 and defining the ends of product 4, and is so positioned inside respective seat 7 that surfaces 11 close respective openings 8 and are aligned with lateral surfaces 6 of wheel 5, and each annular end portion 2 projects in relation to respective surface 11, and extends crosswise from respective surface 11 and outwards of respective seat 7.

Figure 3:
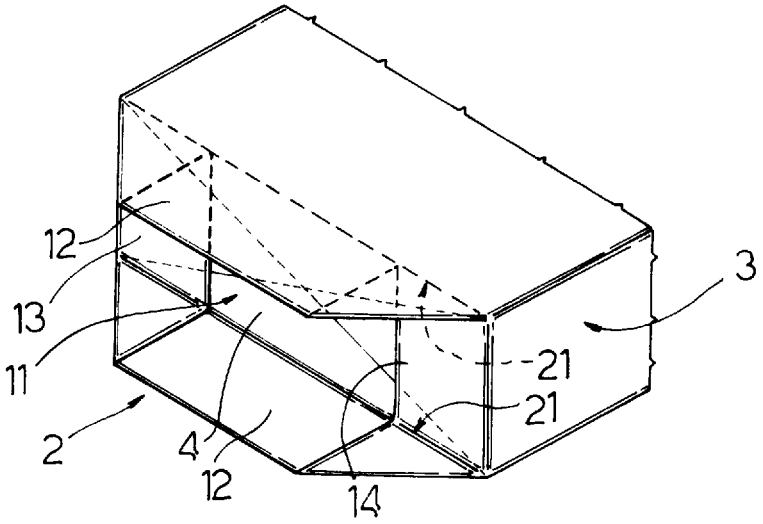

As shown more clearly in FIGS. 2 and 3, each portion 2 comprises two sides 12 parallel to direction D and separated by a given distance equal to at least a thickness S of product 4; a rear portion 13 folded, in known manner at a first of said two stations 10, onto respective end surface 11; and a front portion 14 crosswise to direction D and connecting said two sides 12.

Device 1 also comprises a folding device 15 located at a second of said stations 10, and for folding front portions 14 onto respective end surfaces 11.

For each portion 2, folding device 15 comprises a folding plate 16 defined by a plate facing and coplanar with respective lateral surface 6; and a drive device 17 associated with respective plate 16 and for moving plate 16 in a respective plane K defined by respective surface 6. More specifically, plate 16 is substantially quadrangular, and comprises a folding end surface 18 for pressing against front portion 14 of respective portion 2 and gradually folding portion 14 onto respective surface 11; and two lateral surfaces 19 defining, with surface 18, respective corners 20 separated by a distance equal to thickness S, and which compress respective lateral portions of portion 14 adjacent to sides 12 to further fold portion 14 and form respective angles 21 defined by sides 12 and by surface 11.

Each device 17 comprises a fixed plate 22 coplanar with respective plate 16, located on the opposite side of plate 16 to wheel 5, and having a slot 23 crosswise to direction D at station 10; a motor 24 shown schematically in FIG. 1, and the output shaft 25 of which extends movably through slot 23 and is connected integrally at its free end to plate 16 to rotate plate 16 about an axis 26 crosswise to plane K; and a linear actuator 27 fitted to plate 22 on the opposite side of plate 22 to plate 16, and having an output rod 28 connected in rotary manner at its free end to shaft 25 to move shaft 25 along slot 23 and translate axis 26 parallel to itself.

In actual use, wheel 5 successively receives products 4, together with respective tubular wrappings 3, at said loading station (not shown), and feeds each product 4 at constant speed along path P to said unloading station (not shown). Along path P, each product 4, together with respective wrapping 3, travels through first folding station 10 (not shown) where each rear portion 13, i.e. the portion upstream from product 4 in the traveling direction D of product 4, is folded by a known folding element (not shown) onto the corresponding end surface 11 of product 4.

Figures 4A, 4B, 4C, 4D, 4E, 4F, 4G, 4H:
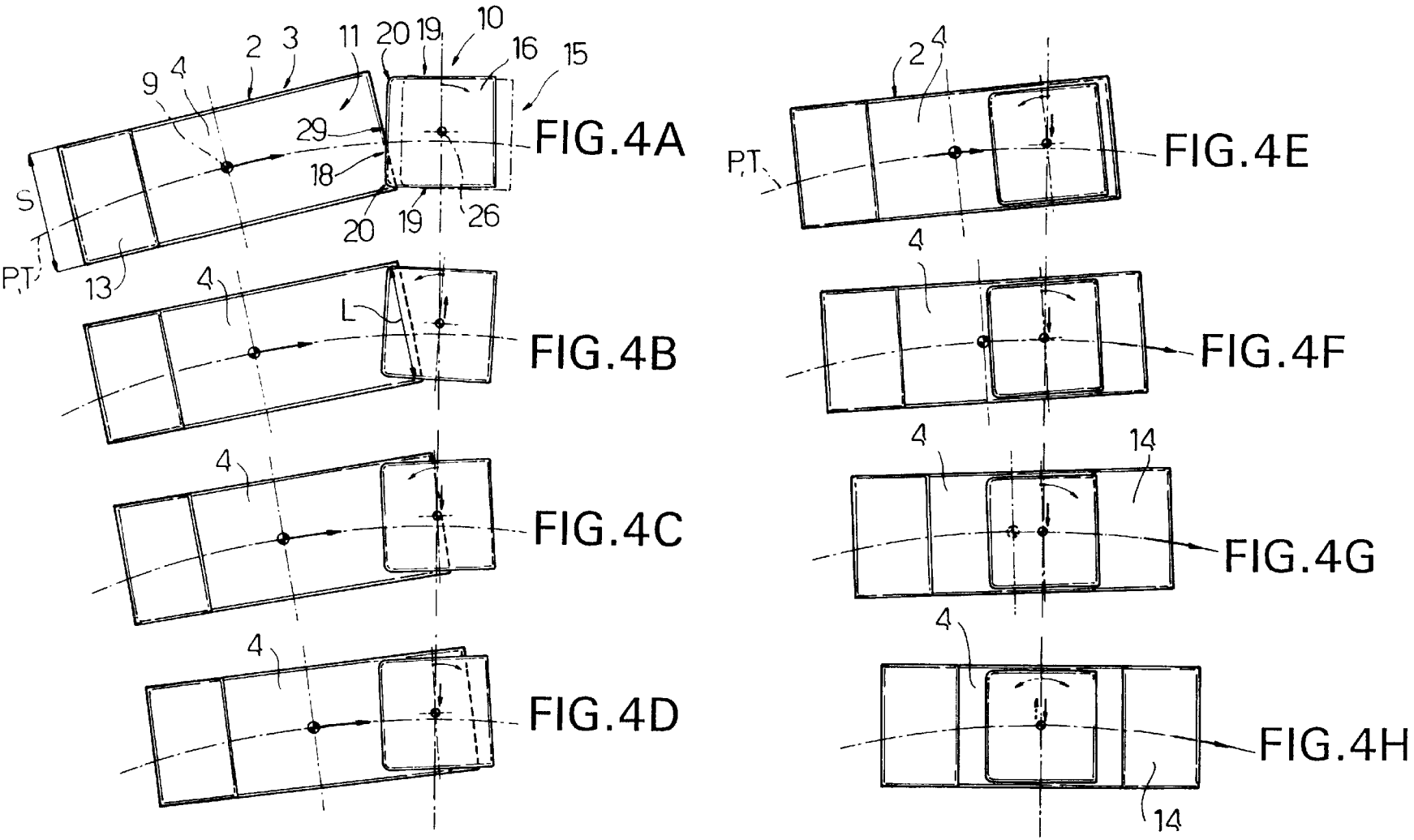
FIGS. 4(*a*) to 4(*h*) show with parts removed for clarity, a detail of FIG. 1 in a succession of operating positions.
Figures 6A, 6B, 6C, 6D, 6E, 6F, 6G, 6H, 6I, 6J:
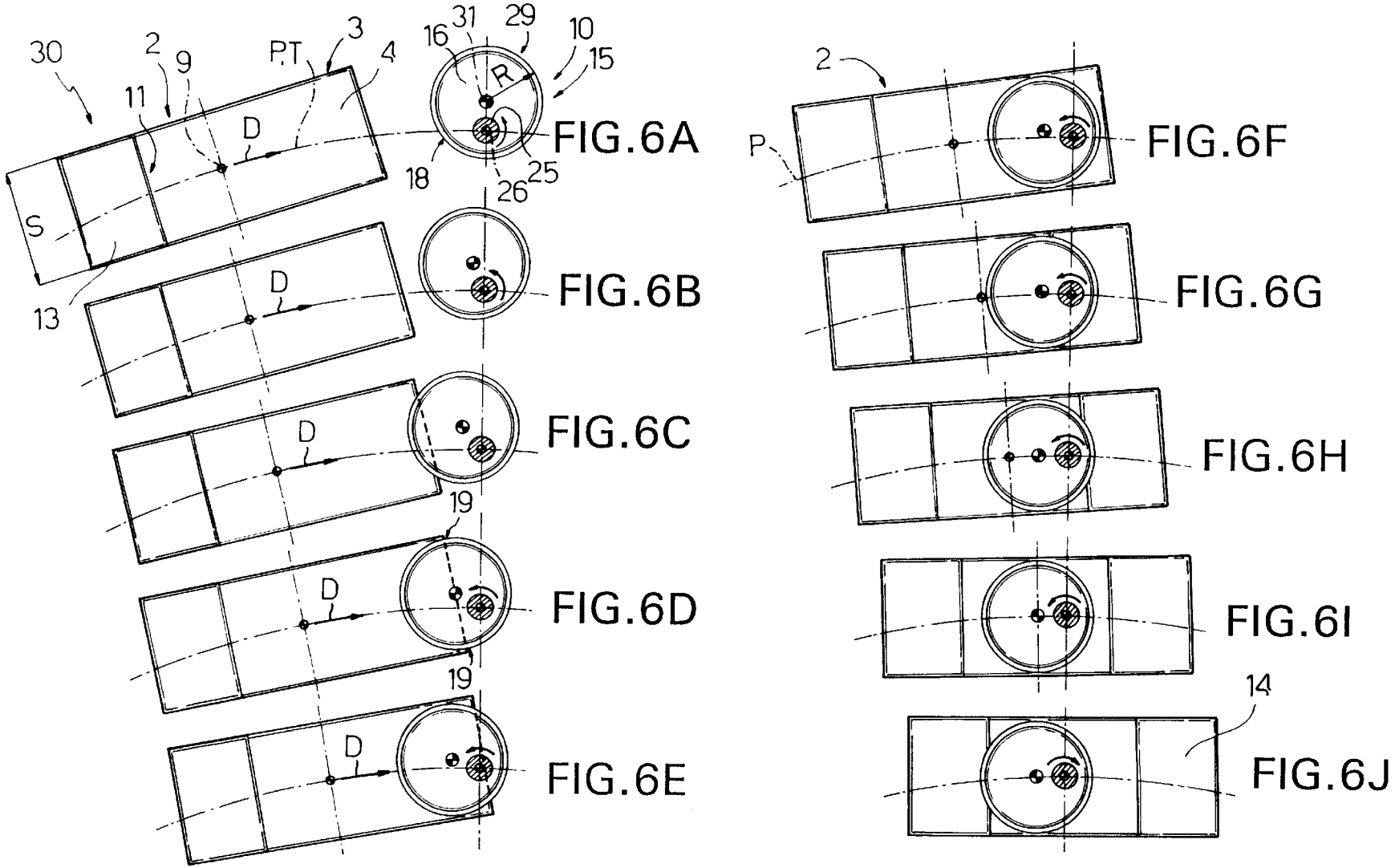
FIGS. 6(*a*) to 6(I) show, with parts removed for clarity, a detail of FIG. 5 in a succession of operating positions.

Once portion 13 has been folded, product 4 is fed to second folding station 10 (FIG. 4*a*), and plate 16—initially set to the idle position (FIG. 1) in which axis 26 is located along the trajectory T traveled by axis 9 of product 4 as product 4 travels along path P—is moved in plane K by drive device 17 and gradually inserted between sides 12 so that an outer folding surface 29 defined by surfaces 18 and 19 is of a maximum width L at most equal to the distance between sides 12.

In other words, as shown in FIGS. 4*a* to 4*e*, plate 16—the width of which is determined by the distance between the two corners 20, i.e. as stated, equals thickness S of product 4—is gradually rotated back and forth clockwise (FIGS. 4*a*, 4*d*) and anticlockwise (FIGS. 4*b*, 4*c*) about axis 26, and at the same time is moved parallel to slot 23 by actuator 27 to move axis 26 first away from (FIGS. 4*a*, 4*b*) and then towards (FIGS. 4*c*, 4*d*) trajectory T. The combination of the rotational movement about axis 26 and the translatory movement parallel to slot 23 enables plate 16 to be inserted gradually between sides 12 without surface 29 colliding with sides 12, but rather in such a manner that lateral surfaces 19 and corners 20 move alternately alongside sides 12, so that angles 21 are also formed on front portion 14 as portion 14 is folded onto end surface 11 of product 4.

As product 4 travels along path P so that plate 16 is fully inserted between sides 12, device 17 so orients plate 16 as to maintain outer folding surface 29 equidistant from, and substantially contacting, both sides 12, i.e. as to keep surfaces 19 parallel to sides 12 and to direction D until product 4 leaves station 10.

Inserting plate 16 between sides 12 as described above therefore enables the use of a plate 16 of a width equal to thickness S of product 4, and provides for correctly forming angles 21, i.e. correctly folding front portion 14.

Figure 5:
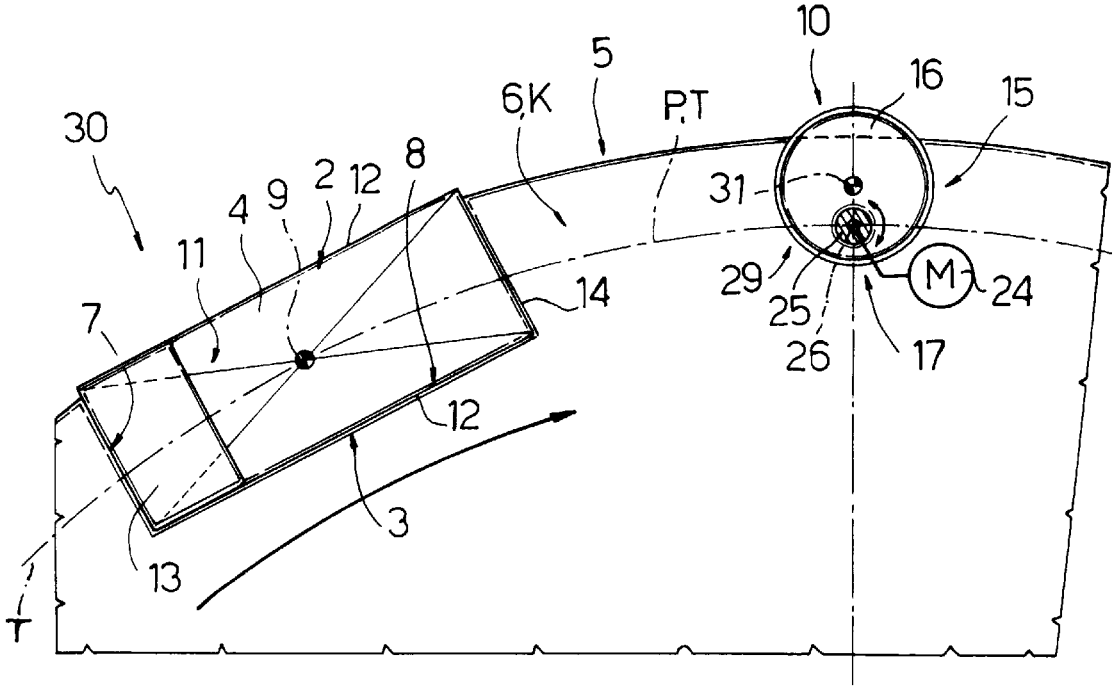
FIG. 5 shows a schematic view, with parts in section and parts removed for clarity, of a second preferred embodiment of the FIG. 1 device.

The FIG. 5 embodiment relates to a folding device 30, which is substantially the same as device 1 in FIG. 1, except that plate 16 is substantially circular, and axis 26 is located in a fixed position along trajectory T.

More specifically, plate 16 of device 30 has a central axis 31 of symmetry parallel to and offset in relation to axis 26, and which is rotated about axis 26 by motor 24 to so orient plate 16 as to insert and slide plate 16 between sides 12. Plate 16 also comprises a given radius R equal to half the thickness S of product 4, and greater than the distance between axes 26 and 31.

Device 30 operates theoretically in the same way as device 1, except that axis 26 is maintained fixed as opposed to being moved parallel to itself; and plate 16 is inserted between sides 12 by simply rotating axis 31 about axis 26 in the same direction all the time (counterclockwise in FIGS. 6*a* to 6*e*), and by first bringing surface 18 into contact with front portion 14.

Angles 21 are formed (FIG. 6*d*) by lateral surfaces 19, which, plate 16 being circular, are only clearly distinguishable from end surface 18 by the position assumed by plate 16 with respect to sides 12.

Once plate 16 is positioned fully facing end surface 11 of product 4 (FIG. 6*f*) and hence between sides 12, motor 24 continues rotating plate 16 in the same direction to keep surface 29 equidistant from, and substantially contacting, both sides 12; and, upon axis 9 of product 4 coinciding with axis 31 of plate 16, motor 24 rotates plate 16 in the opposite direction to enable plate 16 to continue keeping surface 29 equidistant from, and substantially contacting, both sides 12.

I claim:

1. A method of folding end portions (2) of tubular wrappings (3), the method comprising the step of feeding a product (4) along a substantially curved path (P) and in an instantaneous traveling direction (D) tangent to the path (P), the product (4) being enclosed inside a tubular wrapping (3) having at least one annular end portion (2), and the annular end portion (2) projecting with respect to an end surface (11) of the product (4), and comprising two sides (12) parallel to said instantaneous traveling direction (D) and separated by a given distance equal to at least a thickness (S) of the product (4), a rear portion (13) folded onto said end surface (11), and a front portion (14) crosswise to said instantaneous traveling direction (D); and the step of folding said front portion (14) onto said end surface (11) by means of a folding element (16) located along said path (P); the method being characterized in that said folding step comprises the steps of moving the folding element (16) in a plane (K) coplanar with said end surface (11); gradually inserting the folding element (16) between said sides (12) so that an outer folding surface (29) of the folding element (16) is of a maximum width at most equal to said given distance; and so orienting the folding element (16) as to keep the outer folding surface (29) equidistant from, and substantially contacting, both said sides (12).

2. A method as claimed in claim 1, characterized in that said inserting step is performed by rotating the folding element (16) about an an axis (26) of rotation crosswise to said plane (K).

3. A method as claimed in claim 2, characterized in that said inserting step is performed by translating the axis (26) of rotation of said folding element (16) parallel to itself during rotation of the folding element (16).

4. A method as claimed in claim 3, characterized in that said outer folding surface (29) is defined by a broken line comprising a folding face (18) and two folding corners (20); the two corners (20) being separated by a distance equal to said thickness (S).

5. A method as claimed in claim 2, characterized in that said outer folding surface (29) is defined by a circumference having a central axis (31) of symmetry and a given radius (R); the central axis (31) being parallel to said axis (26) of rotation, and having a given eccentricity in relation to the axis (26) of rotation.

6. A method as claimed in claim 5, characterized in that said inserting step is performed by rotating said central axis (31) about the axis (26) of rotation; said radius (R) being equal to half said thickness (S).

7. A device (1)(30) for folding end portions (2) of tubular wrappings (3), the device comprising conveying means (5) for feeding a product (4) along a substantially curved path (P) and in an instantaneous traveling direction (D) tangent to the path (P), the product (4) being enclosed inside a tubular wrapping (3) having at least one annular end portion (2), and the annular end portion (2) projecting with respect to an end surface (11) of the product (4), and comprising two sides (12) parallel to said instantaneous traveling direction (D) and separated by a given distance equal to at least a thickness (S) of the product (4), a rear portion (13) folded onto said end surface (11), and a front portion (14) crosswise to said instantaneous traveling direction (D); and folding means (15) located along said path (P) to fold said front portion onto said end surface (11); the device being characterized in that said folding means (15) comprise a movable folding element (16); and drive means (17) for moving the folding element (16) in a plane (K) coplanar with said end surface (11), gradually inserting the folding element (16) between said sides (12) so that an outer folding surface (29) of the folding element (16) is of a maximum width at most equal to said given distance, and so orienting the folding element (16) as to keep the outer folding surface (29) equidistant from, and substantially contacting, both said sides (12).

8. A device as claimed in claim 7, characterized in that said drive means (17) comprise motor means (24) associated with said folding element (16) to rotate the folding element (16) about an axis (26) of rotation crosswise to said plane (K).

9. A device as claimed in claim 8, characterized in that said drive means (17) comprise actuating means (27) for translating the axis (26) of rotation of said folding element (16) parallel to itself.

10. A device as claimed in claim 9, characterized in that said outer folding surface (29) is defined by a broken line comprising a folding face (18) and two folding corners (20); the two corners (20) being separated by a distance equal to said thickness (S).

11. A device as claimed in claim 8, characterized in that said outer folding surface (29) is defined by a circumference having a central axis (31) of symmetry and a given radius (R); the axis (31) of symmetry being parallel to said axis (26) of rotation, and having a given eccentricity in relation to the axis (26) of rotation.

12. A device as claimed in claim 11, characterized in that said radius (R) is equal to half said thickness (S), and said eccentricity is less than the radius (R).

* * * * *